US010753042B2

(12) United States Patent
Nelson et al.

(10) Patent No.: US 10,753,042 B2
(45) Date of Patent: Aug. 25, 2020

(54) PROCESSES AND SYSTEMS FOR PRODUCING NANOCELLULOSE FROM OLD CORRUGATED CONTAINERS

(71) Applicant: API Intellectual Property Holdings, LLC, Minnetrista, MN (US)

(72) Inventors: Kimberly Nelson, Atlanta, GA (US); Theodora Retsina, Atlanta, GA (US); Lee Hill, Atlanta, GA (US)

(73) Assignee: GranBio Intellectual Property Holdings, LLC, Atlanta, GA (US)

( * ) Notice: Subject to any disclaimer, the term of this patent is extended or adjusted under 35 U.S.C. 154(b) by 340 days.

(21) Appl. No.: 15/629,832

(22) Filed: Jun. 22, 2017

(65) Prior Publication Data

US 2017/0370047 A1 Dec. 28, 2017

Related U.S. Application Data

(60) Provisional application No. 62/356,210, filed on Jun. 29, 2016, provisional application No. 62/355,854, filed on Jun. 28, 2016.

(51) Int. Cl.
*D21C 5/00* (2006.01)

(52) U.S. Cl.
CPC ..... *D21C 5/005* (2013.01); *D21C 5/00* (2013.01)

(58) Field of Classification Search
None
See application file for complete search history.

(56) References Cited

U.S. PATENT DOCUMENTS 5,777,086 A * 7/1998 Klyosov ..... C07G 1/00 530/500
8,999,491 B2 * 4/2015 Blum ..... B31F 1/2886 428/178
2015/0337493 A1 * 11/2015 Heiskanen ..... C08B 15/08 162/9

* cited by examiner

*Primary Examiner* — Jacob T Minskey
(74) *Attorney, Agent, or Firm* — O'Connor & Company; Ryan P. O'Connor

(57) ABSTRACT

In some variations, OCC is screened, cleaned, deinked, and mechanically refined to generate cellulose nanofibrils. The OCC may be subjected to further chemical, physical, or thermal processing, prior to mechanical refining. For example, the OCC may be subjected to hot-water extraction, or fractionation with an acid catalyst, a solvent for lignin, and water. In certain embodiments to produce cellulose nanocrystals, OCC is exposed to AVAP® digestor conditions. The resulting pulp is optionally bleached and is mechanically refined to generate cellulose nanocrystals. In certain embodiments to produce cellulose nanofibrils, OCC is exposed to GreenBox+® digestor conditions. The resulting pulp is mechanically refined to generate cellulose nanofibrils. The site of a system to convert OCC to nanocellulose may be co-located with an existing OCC processing site. The nanocellulose line may be a bolt-on retrofit system to existing infrastructure. In other embodiments, a dedicated plant for converting OCC to nanocellulose is used.

10 Claims, 2 Drawing Sheets

PROCESSES AND SYSTEMS FOR PRODUCING NANOCELLULOSE FROM OLD CORRUGATED CONTAINERS

PRIORITY DATA

This non-provisional patent application claims priority to U.S. Provisional Patent App. No. 62/355,854, filed on Jun. 28, 2016, and to U.S. Provisional Patent App. No. 62/356,210, filed on Jun. 29, 2016, each of which is hereby incorporated by reference herein.

FIELD

The present invention generally relates to nanocellulose and related materials.

BACKGROUND

Despite being the most available natural polymer on earth, it is only recently that cellulose has gained prominence as a nanostructured material, in the form of nanocrystalline cellulose (NCC), nanofibrillar cellulose (NFC), and bacterial cellulose (BC). Nanocellulose is being developed for use in a wide variety of applications such as polymer reinforcement, antimicrobial films, biodegradable food packaging, printing papers, pigments and inks, paper and board packaging, barrier films, adhesives, biocomposites, wound healing, pharmaceuticals and drug delivery, textiles, water-soluble polymers, construction materials, recyclable interior and structural components for the transportation industry, rheology modifiers, low-calorie food additives, cosmetics thickeners, pharmaceutical tablet binders, bioactive paper, pickering stabilizers for emulsion and particle stabilized foams, paint formulations, films for optical switching, and detergents.

Improved processes for producing nanocellulose from biomass at reduced energy costs are needed in the art. Also, improved starting materials (i.e., recycled pulp and paper products) are needed in the art for producing nanocellulose. It would be particularly desirable for new processes to possess feedstock flexibility and process flexibility to produce either or both nanofibrils and nanocrystals, as well as to co-produce sugars, lignin, and other co-products. For some applications, it is desirable to produce nanocellulose with high crystallinity, leading to good mechanical properties of the nanocellulose or composites containing the nanocellulose. For certain applications, it would be beneficial to increase the hydrophobicity of the nanocellulose.

Post-use corrugated packaging material is commonly known as "cardboard," while it is typically referred to as old corrugated containers (OCC) in the industry. Corrugated cardboard can easily be recognized by its multiple-layer structure; the fluted or wavy middle layer between sheets of paper keeps corrugated board light and gives it the strength to carry products. OCC fiber is a high-volume, low-cost recycled feedstock. OCC is mainly composed of cellulose, with relatively low content of hemicellulose, lignin, and impurities. Currently, OCC is mainly used to cost-effectively produce new paper for new board and new containers. At high recycle rates, the strength properties of corrugated containers (produced from recycled OCC) can ultimately deteriorate to unacceptable levels.

It would be desirable to provide a process to convert OCC to nanocellulose. The nanocellulose would have many uses, one of which could be to improve strength of new corrugated containers containing recycled OCC.

SUMMARY OF SOME EMBODIMENTS

In some variations, a process is provided for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) thermally treating the cleaned feedstock with steam or hot water, optionally with an acid catalyst, to generate a treated feedstock; and (d) mechanically refining the treated feedstock to generate cellulose nanofibrils and/or cellulose nanocrystals.

In some embodiments, the non-cellulosic components removed in step (b) include components selected from the groups consisting of solvents, resins, lubricants, solubilizers, surfactants, particulate matter, pigments, dyes, fluorescents, and combinations thereof.

In some embodiments, step (c) includes an acid catalyst, such as a sulfur-containing acid (e.g., $SO_2$).

The treated feedstock may be bleached prior to step (d). Alternatively, or additionally, the cellulose nanofibrils and/or cellulose nanocrystals may be bleached following step (d).

Cellulase enzymes (or other enzymes) may be introduced to the process. In some embodiments, cellulase enzymes are introduced during step (b). In these or other embodiments, cellulase enzymes are introduced between step (c) and step (d), or during step (d), e.g. enzyme addition into the mechanical refiner.

The cellulose nanofibrils and/or cellulose nanocrystals may be introduced to a material comprising corrugating medium pulp or pulp-derived product, to generate an improved corrugating medium pulp or pulp-derived product.

Other variations provide a process for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) digesting the cleaned feedstock with an acid catalyst, a solvent for lignin, and water, to generate a treated feedstock; and (d) mechanically refining the treated feedstock to generate cellulose nanofibrils and/or cellulose nanocrystals.

In some embodiments, the non-cellulosic components removed in step (b) include components selected from the groups consisting of solvents, resins, lubricants, solubilizers, surfactants, particulate matter, pigments, dyes, fluorescents, and combinations thereof.

The acid catalyst is preferably a sulfur-containing acid, such as $SO_2$ or lignosulfonic acid.

The treated feedstock may be bleached prior to step (d). Alternatively, or additionally, the cellulose nanofibrils and/or cellulose nanocrystals may be bleached following step (d).

Cellulase enzymes (or other enzymes) may be introduced to the process. In some embodiments, cellulase enzymes are introduced during step (b). In these or other embodiments, cellulase enzymes are introduced between step (c) and step (d), or during step (d), e.g. enzyme addition into the mechanical refiner. In certain embodiments, step (d) includes multiple stages of mechanical refining, and enzymes may be introduced between stages.

The cellulose nanofibrils and/or cellulose nanocrystals may be introduced to a material comprising corrugating medium pulp or pulp-derived product, to generate an improved corrugating medium pulp or pulp-derived product.

Other variations of this disclosure provide a process for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) enzymatically treating the cleaned feedstock with an enzyme solution comprising cellulase enzymes, to generate a treated feedstock; and (d) mechanically refining the treated feedstock to generate cellulose nanofibrils and/or cellulose nanocrystals.

DETAILED DESCRIPTION OF SOME EMBODIMENTS

Figure 1:
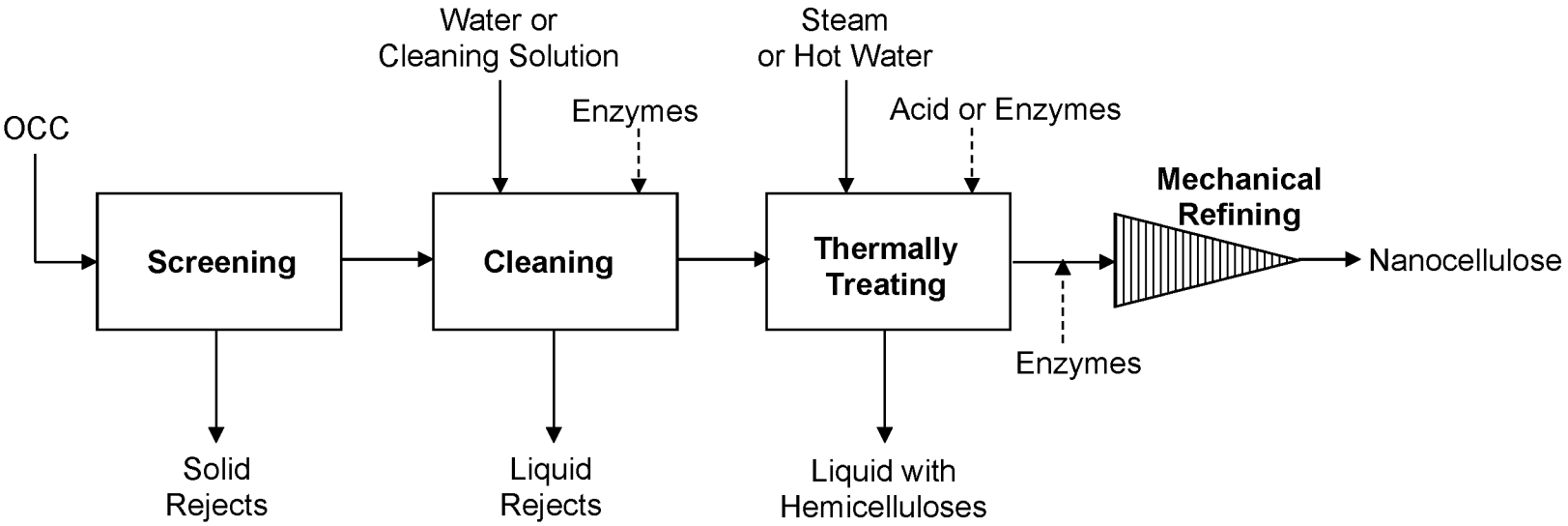
FIG. 1 is an exemplary block-flow diagram of some variations of the invention for converting old corrugated containers (OCC) into nanocellulose.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with any accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs. All composition numbers and ranges based on percentages are weight percentages, unless indicated otherwise. All ranges of numbers or conditions are meant to encompass any specific value contained within the range, rounded to any suitable decimal point.

Unless otherwise indicated, all numbers expressing parameters, reaction conditions, concentrations of components, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Generally it is beneficial to process biomass in a way that effectively separates the major fractions (cellulose, hemicellulose, and lignin) from each other. The cellulose can be subjected to further processing to produce nanocellulose. Fractionation of lignocellulosics leads to release of cellulosic fibers and opens the cell wall structure by dissolution of lignin and hemicellulose between the cellulose microfibrils. The fibers become more accessible for conversion to nanofibrils or nanocrystals. Hemicellulose sugars can be fermented to a variety of products, such as ethanol, or converted to other chemicals. Lignin from biomass has value as a solid fuel and also as an energy feedstock to produce liquid fuels, synthesis gas, or hydrogen; and as an intermediate to make a variety of polymeric compounds. Additionally, minor components such as proteins or rare sugars can be extracted and purified for specialty applications.

This disclosure describes processes and apparatus to efficiently fractionate any lignocellulosic-based biomass into its primary major components (cellulose, lignin, and if present, hemicellulose) so that each can be used in potentially distinct processes. An advantage of the process is that it produces cellulose-rich solids while concurrently producing a liquid phase containing a high yield of both hemicellulose sugars and lignin, and low quantities of lignin and hemicellulose degradation products. The flexible fractionation technique enables multiple uses for the products. The cellulose is an advantaged precursor for producing nanocellulose, as will be described herein.

As intended herein, "nanocellulose" is broadly defined to include a range of cellulosic materials, including but not limited to microfibrillated cellulose, nanofibrillated cellulose, microcrystalline cellulose, nanocrystalline cellulose, and particulated or fibrillated dissolving pulp. Typically, nanocellulose as provided herein will include particles having at least one length dimension (e.g., diameter) on the nanometer scale.

"Nanofibrillated cellulose" or equivalently "cellulose nanofibrils" means cellulose fibers or regions that contain nanometer-sized particles or fibers, or both micron-sized and nanometer-sized particles or fibers. "Nanocrystalline cellulose" or equivalently "cellulose nanocrystals" means cellulose particles, regions, or crystals that contain nanometer-sized domains, or both micron-sized and nanometer-sized domains. "Micron-sized" includes from 1 μm to 100 μm and "nanometer-sized" includes from 0.01 nm to 1000 nm (1 μm). Larger domains (including long fibers) may also be present in these materials.

Certain exemplary embodiments of the invention will now be described. These embodiments are not intended to limit the scope of the invention as claimed. The order of steps may be varied, some steps may be omitted, and/or other steps may be added. Reference herein to first step, second step, etc. is for purposes of illustrating some embodiments only.

This disclosure is predicated on various process and site configurations to convert old corrugated containers (OCC), or a feedstock comprising OCC, to nanocellulose.

"Old corrugated containers," "old corrugating containers," "recycled corrugated containers," and the like refer equivalently to what is known in the industry as old corrugated containers, or OCC. The OCC may include linerboard, corrugating medium (intercalated paper material that spaces apart two linerboards), or both of these components. OCC is the single largest source of recovered paper in waste streams. OCC is used to make new corrugated cartons, linerboard, paperboard, and wallboard, for example.

All references herein to OCC should be construed to include embodiments in which a portion of the feedstock (such as about 1%, 5%, 10%, 20%, 30%, 40%, 50%, 60%, 70%, 80%, or 90%) is OCC while the remainder is fresh biomass, waste biomass, or another waste pulp or pulp product (e.g., recycled paper). In some embodiments, 100% OCC is utilized as the feedstock to produce nanocellulose. In related embodiments, the principles of this disclosure are applied to other cellulosic waste or recycle streams, such as waste cardboard or waste paper, which may or may not be normally regarded as OCC.

In some variations of this disclosure, OCC is screened, cleaned, optionally deinked, and then mechanically refined to generate cellulose nanofibrils, or another form of nanocellulose. The OCC may be subjected to further chemical, physical, or thermal processing, prior to mechanical refining, and preferably after any screening or cleaning (or combined with cleaning, in some embodiments). For example, the OCC may be subjected to steam extraction, hot-water extraction, acidic extraction (such as with sulfur dioxide), solvent extraction, or fractionation with an acid catalyst, a solvent for lignin, and water.

In certain embodiments to produce cellulose nanocrystals, OCC is exposed to AVAP® digestor conditions using a suitable acid catalyst, a solvent for lignin, and water. The resulting pulp is optionally bleached and is mechanically refined to generate cellulose nanocrystals.

In certain embodiments to produce cellulose nanofibrils, OCC is exposed to Green Power+®, GreenBox+® digestor conditions, or GP3+® digestor conditions. The resulting pulp is optionally bleached and is mechanically refined to generate cellulose nanofibrils.

Enzymes may be incorporated into the process. In some embodiments to produce cellulose nanofibrils, enzymes (such as cellulase enzymes) are added to the recycled OCC before mechanical treatment, or during mechanical treatment. In some embodiments, enzymes are added to the OCC at the stage of washing/cleaning. Additives may be introduced to change pH, surface tension, viscosity, enzyme activity, and so on.

In some embodiments to produce cellulose nanocrystals, enzymes (such as cellulase enzymes) are added before and/or after a first mechanical treatment of recycled OCC, followed by generation of nanocrystals in a second mechanical treatment. The use of enzymes to produce cellulose nanocrystals may be with or without feeding the enzymatically treated solids with AVAP® conditions. In certain embodiments, only enzymes and mechanical treatment are applied to OCC to produce cellulose nanocrystals. Again, additives may be introduced to change pH, surface tension, viscosity, enhance enzyme activity, and so on.

The site of a system to convert OCC to nanocellulose may be co-located with an existing or new site that also converts OCC into products other than nanocellulose, such as cartons, linerboard, etc. That is, the nanocellulose line may be a bolt-on retrofit system to existing infrastructure, or it may be built as part of an entirely new biorefinery. In other embodiments, a dedicated plant for converting OCC to nanocellulose is physically isolated from others plants that make or use OCC for other purposes. Such a dedicated plant could be a new plant or a retrofit of an existing site, which is repurposed for OCC-to-nanocellulose conversion.

In some variations, this invention is related to bolting on an AVAP® nanocellulose production plant to an existing pulp mill, and in particular a pulp mill that processes OCC as at least a portion of the mill feedstock.

The feedstock to the AVAP plant from the pulp mill may be never-dried bleached pulp (for bleached nanocellulose grades) or never-dried brown pulp (for lignin coated-nanocellulose grades) delivered to an AVAP digestor at 30-50 wt % solids, for example. A screw press may be installed to take pulp to ~30 wt % solids and directly feed a plug screw feeder of the AVAP digestor. Another embodiment is to use pulp at 50 wt % solids from the press line of a pulp machine as feed to the digestor. This would require shredding/grinding the "wet lap" pulp sheet (using a hammermill, for example) and collecting dust prior to feeding the AVAP digestor.

Advantages of adding a bolt-on AVAP nanocellulose plant to an existing pulp mill include:

(1) High cellulose content of the feed to AVAP. For bleached grades the cellulose content will be >90 wt %. For brown grades the cellulose content will typically be 70-90 wt %. In some embodiments, the AVAP plant does not have to process the dissolved lignin and hemicelluloses, and the nanocellulose yield from the AVAP plant is significantly higher than starting from biomass which is only ~50% cellulose.

(2) Digester, washing, and chemical recovery capital cost is significantly reduced over a stand-alone AVAP plant fed with biomass.

(3) Liquor recovery is simplified and easy to operate—there is less fouling potential from large amounts of lignin, resins, and dissolved hemicelluloses.

(4) Chemical breakdown using AVAP of the pulp fibers from ~4000-5000 DP (degree of polymerization) to the nanoscale (e.g., 1200 DP for fibrils, 250 DP for crystals) significantly reduces the amount of mechanical energy required to liberate the individual nanoparticles.

(5) The AVAP process allows the tunable production of fibrils, crystals, and a mixture as both bleached and unbleached grades. Other bolt-on nanocellulose processes added at existing mills typically only allow production of one product (fibrils from refining and crystals from sulfuric acid method).

Exemplary conditions for AVAP pulping of OCC are a liquor with 12 wt % $SO_2$, 44 wt % ethanol, and 44 wt % water; digestor temperature of 80-105° C. for 25-45 minutes when making nanofibrils or 100-110° C. for 45-75 minutes when making nanocrystals. Generally, temperatures from 70-170° C. with 0-75 wt % ethanol may be employed, in certain embodiments.

Optionally, the cook may be done in the absence of ethanol (or other solvent for lignin) when a bleached pulp is used as the feed. However, even when a bleached (low lignin) feedstock is utilized, the solvent (such as ethanol) may provide a buffering capacity to preserve cellulose crystallinity.

It is noted that in certain embodiments, the OCC feedstock itself might contain some amount of nanocellulose. To the extent such a product penetrates the market, the supply of OCC could have a non-zero average nanocellulose content. Most of the cellulose particles would still be expected to be larger than nanocellulose, and the principles of this disclosure would still apply.

Figure 2:
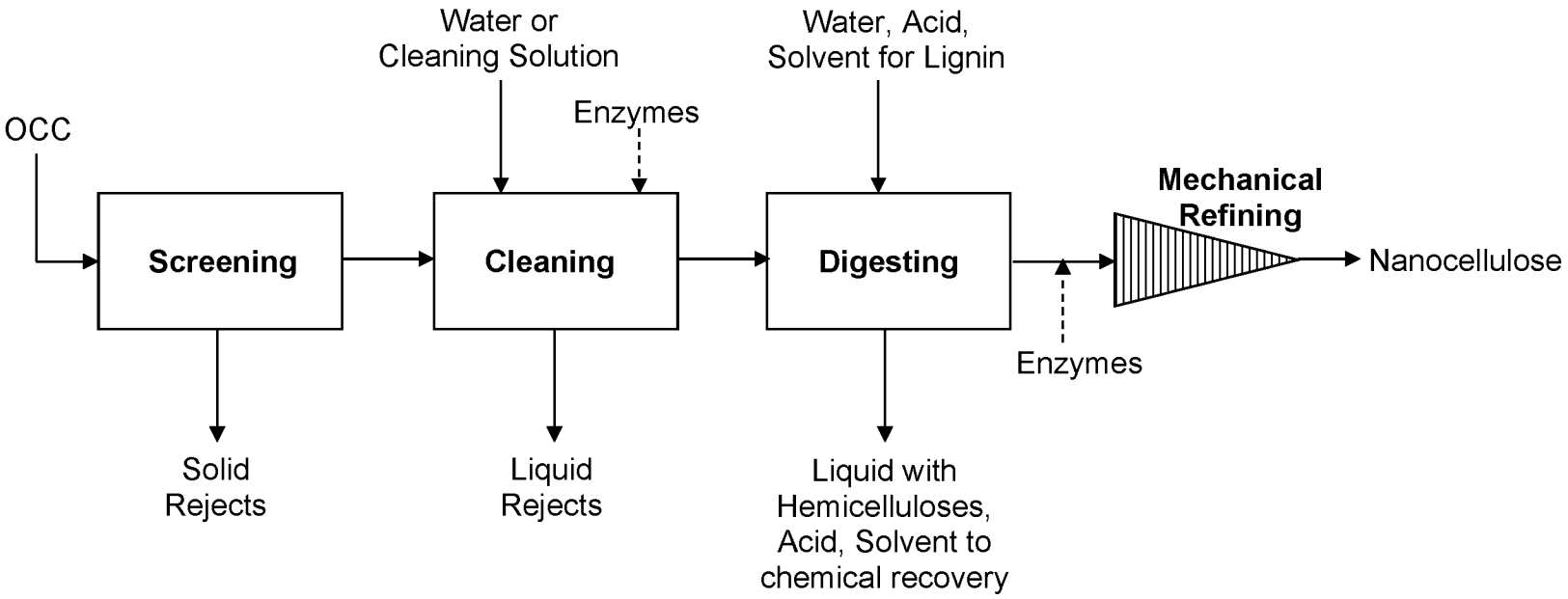
FIG. 2 is an exemplary block-flow diagram of some variations of the invention for converting old corrugated containers (OCC) into nanocellulose.

FIGS. 1 and 2 are exemplary block-flow diagrams of some variations of the invention for converting old corrugated containers (OCC) into nanocellulose. Dotted lines denote optional streams, noting that some optional embodiments (e.g. bleaching) are not explicitly shown in the drawings. In some embodiments, the screening and cleaning unit operations are combined. In some embodiments, the cleaning and thermal-treating (FIG. 1) or digesting (FIG. 2) unit operations are combined.

In some variations, a process is provided for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) thermally treating the cleaned feedstock with steam or hot water, optionally with an acid catalyst, to generate a treated feedstock; and (d) mechanically refining the treated feedstock to generate cellulose nanofibrils and/or cellulose nanocrystals.

In some embodiments, the non-cellulosic components removed in step (b) include components selected from the groups consisting of solvents, resins, lubricants, solubilizers, surfactants, particulate matter, pigments, dyes, fluorescents, and combinations thereof.

In some embodiments, step (c) includes an acid catalyst, such as a sulfur-containing acid (e.g., $SO_2$).

The treated feedstock may be bleached prior to step (d). Alternatively, or additionally, the cellulose nanofibrils and/or cellulose nanocrystals may be bleached following step (d).

Cellulase enzymes (or other enzymes) may be introduced to the process. In some embodiments, cellulase enzymes are introduced during step (b). In these or other embodiments, cellulase enzymes are introduced between step (c) and step (d), or during step (d), e.g. enzyme addition into the mechanical refiner.

The cellulose nanofibrils and/or cellulose nanocrystals may be introduced to a material comprising corrugating medium pulp or pulp-derived product, to generate an improved corrugating medium pulp or pulp-derived product.

Other variations provide a process for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) digesting the cleaned feedstock with an acid catalyst, a solvent for lignin, and water, to generate a treated feedstock; and (d) mechanically refining the treated feedstock to generate cellulose nanofibrils and/or cellulose nanocrystals.

In some embodiments, the non-cellulosic components removed in step (b) include components selected from the groups consisting of solvents, resins, lubricants, solubilizers, surfactants, particulate matter, pigments, dyes, fluorescents, and combinations thereof.

The acid catalyst is preferably a sulfur-containing acid, such as $SO_2$ or lignosulfonic acid.

The treated feedstock may be bleached prior to step (d). Alternatively, or additionally, the cellulose nanofibrils and/or cellulose nanocrystals may be bleached following step (d).

Cellulase enzymes (or other enzymes) may be introduced to the process. In some embodiments, cellulase enzymes are introduced during step (b). In these or other embodiments, cellulase enzymes are introduced between step (c) and step (d), or during step (d), e.g. enzyme addition into the mechanical refiner. In certain embodiments, step (d) includes multiple stages of mechanical refining, and enzymes may be introduced between stages.

The cellulose nanofibrils and/or cellulose nanocrystals may be introduced to a material comprising corrugating medium pulp or pulp-derived product, to generate an improved corrugating medium pulp or pulp-derived product.

Other variations of this disclosure provide a process for producing cellulose nanofibrils and/or cellulose nanocrystals from old corrugated containers, the process comprising:

(a) providing a feedstock comprising old corrugated containers;

(b) screening and cleaning the feedstock to remove one or more non-cellulosic components contained in the feedstock, to generate a cleaned feedstock;

(c) enzymatically treating the cleaned feedstock with an enzyme solution comprising cellulase enzymes, to generate a treated feedstock; and (d) mechanically refining the treated feedstock to generate cellulose nanofibrils and/or cellulose nanocrystals.

In this disclosure, "lignocellulosic biomass feedstock" is meant to include, but is not limited to, various pulp materials such as chemical pulp, mechanical pulp, chemimechanical pulp, thermomechanical pulp, chemithermomechanical pulp, or a combination thereof. The pulp material may be bleached or unbleached, and is preferably never-dried but could be dried at least to some extent. In some embodiments, the pulp material is a kraft pulp, a sulfite pulp, a soda pulp, or a combination thereof. In some embodiments, the pulp material is recycled pulp from a pulp and paper mill, or recycled pulp from a paper product, for example.

The biomass feedstock may be selected from hardwoods, softwoods, forest residues, eucalyptus, industrial wastes, pulp and paper wastes, consumer wastes, recycled materials containing cellulose, cotton, or combinations thereof. Some embodiments utilize agricultural residues, which include lignocellulosic biomass associated with food crops, annual grasses, energy crops, or other annually renewable feedstocks. Exemplary agricultural residues include, but are not limited to, corn stover, corn fiber, wheat straw, sugarcane bagasse, sugarcane straw, rice straw, oat straw, barley straw, miscanthus, energy cane straw/residue, or combinations thereof. The process disclosed herein benefits from feedstock flexibility; it is effective for a wide variety of cellulose-containing feedstocks.

As used herein, "lignocellulosic biomass" means any material containing cellulose and lignin. Lignocellulosic biomass may also contain hemicellulose. Mixtures of one or more types of biomass can be used. In some embodiments, the biomass feedstock comprises both a lignocellulosic component (such as one described above) in addition to a sucrose-containing component (e.g., sugarcane or energy cane) and/or a starch component (e.g., corn, wheat, rice, etc.). Various moisture levels may be associated with the starting biomass. The biomass feedstock need not be, but may be, relatively dry. In general, the biomass is in the form of a particulate or chip, but particle size is not critical in this invention.

In some embodiments, the acid (when present in the process) is selected from the group consisting of sulfur dioxide, sulfurous acid, sulfur trioxide, sulfuric acid, lignosulfonic acid, and combinations thereof. In particular embodiments, the acid is sulfur dioxide.

In some embodiments, the cellulose-rich solids are treated with a total mechanical energy of less than about 5000 kilowatt-hours per ton of the cellulose-rich solids, such as less than about 4000, 3000, 2000, or 1000 kilowatt-hours per ton of the cellulose-rich solids. Energy consumption may be measured in any other suitable units. An ammeter measuring current drawn by a motor driving the mechanical treatment device is one way to obtain an estimate of the total mechanical energy.

Mechanically treating may employ one or more known techniques such as, but by no means limited to, milling, grinding, beating, sonicating, or any other means to form or release nanofibrils and/or nanocrystals in the cellulose. Essentially, any type of mill or device that physically separates fibers may be utilized. Such mills are well-known in the industry and include, without limitation, Valley beaters, single disk refiners, double disk refiners, conical refiners, including both wide angle and narrow angle, cylindrical refiners, homogenizers, microfluidizers, and other similar milling or grinding apparatus. See, for example, Smook, *Handbook for Pulp & Paper Technologists*, Tappi Press, 1992; and Hubbe et al., "Cellulose Nanocomposites: A Review," *BioResources* 3(3), 929-980 (2008).

The extent of mechanical treatment may be monitored during the process by any of several means. Certain optical instruments can provide continuous data relating to the fiber length distributions and % fines, either of which may be used to define endpoints for the mechanical treatment step. The time, temperature, and pressure may vary during mechanical treatment. For example, in some embodiments, sonication for a time from about 5 minutes to 2 hours, at ambient temperature and pressure, may be utilized.

In some embodiments, a portion of the cellulose-rich solids is converted to nanofibrils while the remainder of the cellulose-rich solids is not fibrillated. In various embodiments, about 10%, 20%, 30%, 40%, 50%, 60%, 70%, 80%, 90%, 95%, 99%, or substantially all of the cellulose-rich solids are fibrillated into nanofibrils.

In some embodiments, a portion of the nanofibrils is converted to nanocrystals while the remainder of the nanofibrils is not converted to nanocrystals. In various embodiments, about 10%, 20%, 30%, 40%, 50%, 60%, 70%, 80%, 90%, 95%, 99%, or substantially all of the nanofibrils are converted to nanocrystals. During drying, it is possible for a small amount of nanocrystals to come back together and form nanofibrils.

Following mechanical treatment, the nanocellulose material may be classified by particle size. A portion of material may be subjected to a separate process, such as enzymatic hydrolysis to produce glucose. Such material may have good crystallinity, for example, but may not have desirable particle size or degree of polymerization.

The process may further comprise treatment of the cellulose-rich solids with one or more enzymes or with one or more acids. When acids are employed, they may be selected from the group consisting of sulfur dioxide, sulfurous acid, lignosulfonic acid, acetic acid, formic acid, and combinations thereof. Acids associated with hemicellulose, such as acetic acid or uronic acids, may be employed, alone or in conjunction with other acids. Also, the process may include treatment of the cellulose-rich solids with heat. In some embodiments, the process does not employ any enzymes or acids.

When an acid is employed, the acid may be a strong acid such as sulfuric acid, nitric acid, or phosphoric acid, for example. Weaker acids may be employed, under more severe temperature and/or time. Enzymes that hydrolyze cellulose (i.e., cellulases) and possibly hemicellulose (i.e., with hemicellulase activity) may be employed in step (c), either instead of acids, or potentially in a sequential configuration before or after acidic hydrolysis.

In some embodiments, the process comprises enzymatically treating the cellulose-rich solids to hydrolyze amorphous cellulose. In other embodiments, or sequentially prior to or after enzymatic treatment, the process may comprise acid-treating the cellulose-rich solids to hydrolyze amorphous cellulose.

In some embodiments, the process further comprises enzymatically treating the nanocrystalline cellulose. In other embodiments, or sequentially prior to or after enzymatic treatment, the process further comprises acid-treating treating the nanocrystalline cellulose.

If desired, an enzymatic treatment may be employed prior to, or possibly simultaneously with, the mechanical treatment. However, in preferred embodiments, no enzyme treatment is necessary to hydrolyze amorphous cellulose or weaken the structure of the fiber walls before isolation of nanofibers.

Following mechanical treatment, the nanocellulose may be recovered. Separation of cellulose nanofibrils and/or nanocrystals may be accomplished using apparatus capable of disintegrating the ultrastructure of the cell wall while preserving the integrity of the nanofibrils. For example, a homogenizer may be employed. In some embodiments, cellulose aggregate fibrils are recovered, having component fibrils in range of 1-100 nm width, wherein the fibrils have not been completely separated from each other.

The process may further comprise bleaching the cellulose-rich solids. Alternatively, or additionally, the process may further comprise bleaching the nanocellulose material. Any known bleaching technology or sequence may be employed, including enzymatic bleaching.

The nanocellulose material may include, or consist essentially of, nanofibrillated cellulose. The nanocellulose material may include, or consist essentially of, nanocrystalline cellulose. In some embodiments, the nanocellulose material may include, or consist essentially of, nanofibrillated cellulose and nanocrystalline cellulose.

In some embodiments, the crystallinity of the cellulose-rich solids (i.e., the nanocellulose precursor material) is at least 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86% or higher. In these or other embodiments, the crystallinity of the nanocellulose material is at least 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86% or higher. The crystallinity may be measured using any known techniques. For example, X-ray diffraction and solid-state $^{13}C$ nuclear magnetic resonance may be utilized.

In some embodiments, the nanocellulose material is characterized by an average length-to-width aspect ratio of particles from about 10 to about 1000, such as about 15, 20, 25, 35, 50, 75, 100, 150, 200, 250, 300, 400, or 500. Nanofibrils are generally associated with higher aspect ratios than nanocrystals. Nanocrystals, for example, may have a length range of about 100 nm to 500 nm and a diameter of about 4 nm, translating to an aspect ratio of 25 to 125. Nanofibrils may have a length of about 2000 nm and diameter range of 5 to 50 nm, translating to an aspect ratio of 40 to 400. In some embodiments, the aspect ratio is less than 50, less than 45, less than 40, less than 35, less than 30, less than 25, less than 20, less than 15, or less than 10.

Optionally, the process further comprises hydrolyzing amorphous cellulose into glucose, recovering the glucose, and fermenting the glucose to a fermentation product. The glucose may be purified and sold. Or the glucose may be fermented to a fermentation product, such as but not limited to ethanol. The glucose or a fermentation product may be recycled to the front end, such as to hemicellulose sugar processing, if desired. Optionally, the process further comprises recovering, fermenting, or further treating hemicellulosic sugars derived from the hemicellulose. Optionally, the process further comprises recovering, combusting, or further treating the lignin.

When hemicellulosic sugars are recovered and fermented, they may be fermented to produce a monomer or precursor thereof. The monomer may be polymerized to produce a polymer, which may then be combined with the nanocellulose material to form a polymer-nanocellulose composite.

In some embodiments, the nanocellulose material is at least partially hydrophobic via deposition of at least some of the lignin onto a surface of the cellulose-rich solids.

In some embodiments, the process further comprises chemically converting the nanocellulose material to one or more nanocellulose derivatives. For example, nanocellulose derivatives may be selected from the group consisting of nanocellulose esters, nanocellulose ethers, nanocellulose ether esters, alkylated nanocellulose compounds, cross-linked nanocellulose compounds, acid-functionalized nanocellulose compounds, base-functionalized nanocellulose compounds, and combinations thereof.

Various types of nanocellulose functionalization or derivatization may be employed, such as functionalization using polymers, chemical surface modification, functionalization using nanoparticles (i.e. other nanoparticles besides the nanocellulose), modification with inorganics or surfactants, or biochemical modification.

Certain variations provide a process for producing a nanocellulose material, the process comprising:

(a) providing an OCC feedstock that has been screened and cleaned;

(b) fractionating the feedstock in the presence of sulfur dioxide, a solvent for lignin, and water, to generate cellulose-rich solids and a liquid containing hemicellulose oligomers and lignin, wherein the crystallinity of the cellulose-rich solids is at least 70%, wherein $SO_2$ concentration is from about 10 wt % to about 50 wt %, fractionation temperature is from about 130° C. to about 200° C., and fractionation time is from about 30 minutes to about 4 hours;

(c) mechanically treating the cellulose-rich solids to form cellulose fibrils and/or cellulose crystals, thereby generating a nanocellulose material having a crystallinity of at least 70%; and (d) recovering the nanocellulose material.

In some embodiments, the $SO_2$ concentration is from about 12 wt % to about 30 wt %. In some embodiments, the fractionation temperature is from about 140° C. to about 170° C. In some embodiments, the fractionation time is from about 1 hour to about 2 hours. The process may be controlled such that during step (b), a portion of the solubilized lignin intentionally deposits back onto a surface of the cellulose-rich solids, thereby rendering the cellulose-rich solids at least partially hydrophobic.

A significant factor limiting the application of strength-enhancing, lightweight nanocellulose in composites is cellulose's inherent hydrophilicity. Surface modification of the nanocellulose surface to impart hydrophobicity to enable uniform dispersion in a hydrophobic polymer matrix is an active area of study. It has been discovered that when preparing nanocellulose using the processes described herein, lignin may condense on pulp under certain conditions, giving a rise in Kappa number and production of a brown or black material. The lignin increases the hydrophobicity of the nanocellulose precursor material, and that hydrophobicity is retained during mechanical treatment provided that there is not removal of the lignin through bleaching or other steps. (Some bleaching may still be performed, either to adjust lignin content or to attack a certain type of lignin, for example.)

Step (b) may include process conditions, such as extended time and/or temperature, or reduced concentration of solvent for lignin, which tend to promote lignin deposition onto fibers. Alternatively, or additionally, step (b) may include one or more washing steps that are adapted to deposit at least some of the lignin that was solubilized during the initial fractionation. One approach is to wash with water rather than a solution of water and solvent. Because lignin is generally not soluble in water, it will begin to precipitate. Optionally, other conditions may be varied, such as pH and temperature, during fractionation, washing, or other steps, to optimize the amount of lignin deposited on surfaces. It is noted that in order for the lignin surface concentration to be higher than the bulk concentration, the lignin needs to be first pulled into solution and then redeposited; internal lignin (within particles of nanocellulose) does not enhance hydrophobicity in the same way.

Optionally, the process for producing a hydrophobic nanocellulose material may further include chemically modifying the lignin to increase hydrophobicity of the nanocellulose material. The chemical modification of lignin may be conducted during step (b), step (c), step (d), following step (d), or some combination.

High loading rates of lignin have been achieved in thermoplastics. Even higher loading levels are obtained with well-known modifications of lignin. The preparation of useful polymeric materials containing a substantial amount of lignin has been the subject of investigations for more than thirty years. Typically, lignin may be blended into polyolefins or polyesters by extrusion up to 25-40 wt % while satisfying mechanical characteristics. In order to increase the compatibility between lignin and other hydrophobic polymers, different approaches have been used. For example, chemical modification of lignin may be accomplished through esterification with long-chain fatty acids.

Any known chemical modifications may be carried out on the lignin, to further increase the hydrophobic nature of the lignin-coated nanocellulose material provided by embodiments of this invention.

The present invention also provides, in some variations, a process for producing a nanocellulose-containing product that contains the nanocellulose produced as described above.

The nanocellulose-containing product includes the nanocellulose material, or a treated form thereof. In some embodiments, the nanocellulose-containing product consists essentially of the nanocellulose material.

In some embodiments, the process comprises forming a structural object that includes the nanocellulose material, or a derivative thereof.

In some embodiments, the process comprises forming a foam or aerogel that includes the nanocellulose material, or a derivative thereof.

In some embodiments, the process comprises combining the nanocellulose material, or a derivative thereof, with one or more other materials to form a composite. For example, the other material may include a polymer selected from polyolefins, polyesters, polyurethanes, polyamides, or combinations thereof. Alternatively, or additionally, the other material may include carbon in various forms.

The nanocellulose material incorporated into a nanocellulose-containing product may be at least partially hydrophobic via deposition of at least some of the lignin onto a surface of the cellulose-rich solids.

In some embodiments, the process comprises forming a film comprising the nanocellulose material, or a derivative thereof. The film is optically transparent and flexible, in certain embodiments.

In some embodiments, the process comprises forming a coating or coating precursor comprising the nanocellulose material, or a derivative thereof. In some embodiments, the nanocellulose-containing product is a paper coating.

In some embodiments, the nanocellulose-containing product is configured as a catalyst, catalyst substrate, or co-catalyst. In some embodiments, the nanocellulose-containing product is configured electrochemically for carrying or storing an electrical current or voltage.

In some embodiments, the nanocellulose-containing product is incorporated into a filter, membrane, or other separation device.

In some embodiments, the nanocellulose-containing product is incorporated as an additive into a coating, paint, or adhesive. In some embodiments, the nanocellulose-containing product is incorporated as a cement additive.

In some embodiments, the nanocellulose-containing product is incorporated as a thickening agent or rheological modifier. For example, the nanocellulose-containing product may be an additive in a drilling fluid, such as (but not limited to) an oil recovery fluid and/or a gas recovery fluid.

The present invention also provides nanocellulose compositions. In some variations, a nanocellulose composition comprises nanofibrillated cellulose with a cellulose crystallinity of about 70% or greater. The nanocellulose composition may include lignin and sulfur.

The nanocellulose material may further contain some sulfonated lignin that is derived from sulfonation reactions with $SO_2$ (when used as the acid in fractionation) during the biomass digestion. The amount of sulfonated lignin may be about 0.1 wt % (or less), 0.2 wt %, 0.5 wt %, 0.8 wt %, 1 wt %, or more. Also, without being limited by any theory, it is speculated that a small amount of sulfur may chemically react with cellulose itself, in some embodiments.

In some variations, a nanocellulose composition comprises nanofibrillated cellulose and nanocrystalline cellulose, wherein the nanocellulose composition is characterized by an overall cellulose crystallinity of about 70% or greater. The nanocellulose composition may include lignin and sulfur.

In some variations, a nanocellulose composition comprises nanocrystalline cellulose with a cellulose crystallinity of about 80% or greater, wherein the nanocellulose composition comprises lignin and sulfur.

In some embodiments, the cellulose crystallinity is about 75% or greater, such as about 80% or greater, or about 85% or greater. In various embodiments, the nanocellulose composition is not derived from tunicates.

Other variations provide a hydrophobic nanocellulose composition with a cellulose crystallinity of about 70% or greater, wherein the nanocellulose composition contains nanocellulose particles having a surface concentration of lignin that is greater than a bulk (internal particle) concentration of lignin. In some embodiments, there is a coating or thin film of lignin on nanocellulose particles, but the coating or film need not be uniform.

The hydrophobic nanocellulose composition may have a cellulose crystallinity is about 75% or greater, about 80% or greater, or about 85% or greater. The hydrophobic nanocellulose composition may further include sulfur.

The hydrophobic nanocellulose composition may or may not be derived from tunicates. The hydrophobic nanocellulose composition may be free of enzymes.

A nanocellulose-containing product may include any of the disclosed nanocellulose compositions. Many nanocellulose-containing products are possible. For example, a nanocellulose-containing product may be selected from the group consisting of a structural object, a foam, an aerogel, a polymer composite, a carbon composite, a film, a coating, a coating precursor, a current or voltage carrier, a filter, a membrane, a catalyst, a catalyst substrate, a coating additive, a paint additive, an adhesive additive, a cement additive, a paper coating, a thickening agent, a rheological modifier, an additive for a drilling fluid, and combinations or derivatives thereof.

Certain nanocellulose-containing products provide high transparency, good mechanical strength, and/or enhanced gas (e.g., $O_2$ or $CO_2$) barrier properties, for example. Certain nanocellulose-containing products containing hydrophobic nanocellulose materials provided herein may be useful as anti-wetting and anti-icing coatings, for example.

Due to the low mechanical energy input, nanocellulose-containing products provided herein may be characterized by fewer defects that normally result from intense mechanical treatment.

Some embodiments provide nanocellulose-containing products with applications for sensors, catalysts, antimicrobial materials, current carrying and energy storage capabilities. Cellulose nanocrystals have the capacity to assist in the synthesis of metallic and semiconducting nanoparticle chains.

Some embodiments provide composites containing nanocellulose and a carbon-containing material, such as (but not limited to) lignin, graphite, graphene, or carbon aerogels.

Cellulose nanocrystals may be coupled with the stabilizing properties of surfactants and exploited for the fabrication of nanoarchitectures of various semiconducting materials.

The reactive surface of —OH side groups in nanocellulose facilitates grafting chemical species to achieve different surface properties. Surface functionalization allows the tailoring of particle surface chemistry to facilitate self-assembly, controlled dispersion within a wide range of matrix polymers, and control of both the particle-particle and particle-matrix bond strength. Composites may be transparent, have tensile strengths greater than cast iron, and have very low coefficient of thermal expansion. Potential applications include, but are not limited to, barrier films, antimicrobial films, transparent films, flexible displays, reinforcing fillers for polymers, biomedical implants, pharmaceuticals, drug delivery, fibers and textiles, templates for electronic components, separation membranes, batteries, supercapacitors, electroactive polymers, and many others.

Other nanocellulose applications suitable to the present invention include reinforced polymers, high-strength spun fibers and textiles, advanced composite materials, films for barrier and other properties, additives for coatings, paints, lacquers and adhesives, switchable optical devices, pharmaceuticals and drug delivery systems, bone replacement and tooth repair, improved paper, packaging and building products, additives for foods and cosmetics, catalysts, and hydrogels.

Aerospace and transportation composites may benefit from high crystallinity. Automotive applications include nanocellulose composites with polypropylene, polyamide (e.g. Nylons), or polyesters (e.g. PBT).

Nanocellulose materials provided herein are suitable as strength-enhancing additives for renewable and biodegradable composites. The cellulosic nanofibrillar structures may function as a binder between two organic phases for improved fracture toughness and prevention of crack formation for application in packaging, construction materials, appliances, and renewable fibers.

Nanocellulose materials provided herein are suitable as transparent and dimensional stable strength-enhancing additives and substrates for application in flexible displays, flexible circuits, printable electronics, and flexible solar panels. Nanocellulose is incorporated into the substrate-sheets are formed by vacuum filtration, dried under pressure and calandered, for example. In a sheet structure, nanocellulose acts as a glue between the filler aggregates. The formed calandered sheets are smooth and flexible.

Nanocellulose materials provided herein are suitable for composite and cement additives allowing for crack reduction and increased toughness and strength. Foamed, cellular nanocellulose-concrete hybrid materials allow for lightweight structures with increased crack reduction and strength.

Strength enhancement with nanocellulose increases both the binding area and binding strength for application in high strength, high bulk, high filler content paper and board with enhanced moisture and oxygen barrier properties. The pulp and paper industry in particular may benefit from nanocellulose materials provided herein.

Nanofibrillated cellulose nanopaper has a higher density and higher tensile mechanical properties than conventional paper. It can also be optically transparent and flexible, with low thermal expansion and excellent oxygen barrier characteristics. The functionality of the nanopaper can be further broadened by incorporating other entities such as carbon nanotubes, nanoclay or a conductive polymer coating.

Porous nanocellulose may be used for cellular bioplastics, insulation and plastics and bioactive membranes and filters. Highly porous nanocellulose materials are generally of high interest in the manufacturing of filtration media as well as for biomedical applications, e.g., in dialysis membranes.

Nanocellulose materials provided herein are suitable as coating materials as they are expected to have a high oxygen barrier and affinity to wood fibers for application in food packaging and printing papers.

Nanocellulose materials provided herein are suitable as additives to improve the durability of paint, protecting paints and varnishes from attrition caused by UV radiation.

Nanocellulose materials provided herein are suitable as thickening agents in food and cosmetics products. Nanocellulose can be used as thixotropic, biodegradable, dimensionally stable thickener (stable against temperature and salt addition). Nanocellulose materials provided herein are suitable as a Pickering stabilizer for emulsions and particle stabilized foam.

The large surface area of these nanocellulose materials in combination with their biodegradability makes them attractive materials for highly porous, mechanically stable aerogels. Nanocellulose aerogels display a porosity of 95% or higher, and they are ductile and flexible.

Drilling fluids are fluids used in drilling in the natural gas and oil industries, as well as other industries that use large drilling equipment. The drilling fluids are used to lubricate, provide hydrostatic pressure, and to keep the drill cool, and the hole as clean as possible of drill cuttings. Nanocellulose materials provided herein are suitable as additives to these drilling fluids.

The present invention also provides systems configured for carrying out the disclosed processes, and compositions produced therefrom. Any stream generated by the disclosed processes may be partially or completed recovered, purified or further treated, and/or marketed or sold.

In this detailed description, reference has been made to multiple embodiments of the invention and non-limiting examples relating to how the invention can be understood and practiced. Other embodiments that do not provide all of the features and advantages set forth herein may be utilized, without departing from the spirit and scope of the present invention. This invention incorporates routine experimentation and optimization of the methods and systems described herein. Such modifications and variations are considered to be within the scope of the invention defined by the claims.

All publications, patents, and patent applications cited in this specification are herein incorporated by reference in their entirety as if each publication, patent, or patent application were specifically and individually put forth herein.

Where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially.

Therefore, to the extent there are variations of the invention, which are within the spirit of the disclosure or equivalent to the inventions found in the appended claims, it is the intent that this patent will cover those variations as well. The present invention shall only be limited by what is claimed.

What is claimed is:

1. A process for producing cellulose nanofibrils and/or cellulose nanocrystals from old corrugated containers, said process comprising:

(a) providing a feedstock comprising old corrugated containers;

(b) screening and cleaning said feedstock to remove one or more non-cellulosic components contained in said feedstock, to generate a cleaned feedstock;

(c) digesting said cleaned feedstock with an acid catalyst, a solvent for lignin, and water, to generate a treated feedstock;

(d) optionally bleaching said treated feedstock;

(e) mechanically refining said treated feedstock to generate cellulose nanofibrils and/or cellulose nanocrystals; and (f) optionally bleaching said cellulose nanofibrils and/or cellulose nanocrystals.

2. The process of claim 1, wherein said one or more non-cellulosic components removed in step (b) include components selected from the groups consisting of solvents, resins, lubricants, solubilizers, surfactants, particulate matter, pigments, dyes, fluorescents, and combinations thereof.

3. The process of claim 1, wherein said acid catalyst is a sulfur-containing acid, and wherein said sulfur-containing acid is optionally sulfur dioxide.

4. The process of claim 1, wherein step (d) is carried out.

5. The process of claim 1, wherein step (f) is carried out.

6. The process of claim 1, wherein cellulase enzymes are introduced to said process.

7. The process of claim 6, wherein said cellulase enzymes are introduced during step (b).

8. The process of claim 6, wherein said cellulase enzymes are introduced between step (c) and step (e).

9. The process of claim 6, wherein said cellulase enzymes are introduced during step (e), and wherein step (e) optionally includes multiple stages of mechanical refining.

10. The process of claim 1, said process further comprising introducing said cellulose nanofibrils and/or cellulose nanocrystals to a material comprising corrugating medium pulp.

* * * * *